US005511937A

United States Patent [19]

Papageorgiou

[11] Patent Number: 5,511,937

[45] Date of Patent: Apr. 30, 1996

[54] GAS TURBINE AIRFOIL WITH A COOLING AIR REGULATING SEAL

[75] Inventor: Theodore Papageorgiou, Winter Park, Fla.

[73] Assignee: Westinghouse Electric Corporation, Pittsburgh, Pa.

[21] Appl. No.: 315,420

[22] Filed: Sep. 30, 1994

[51] Int. Cl.[6] ..... F01D 9/02; F01D 5/18

[52] U.S. Cl. ..... 415/115; 416/96 A; 416/97 R

[58] Field of Search ..... 415/115; 416/96 A, 416/97 R

[56] References Cited

U.S. PATENT DOCUMENTS

| | | | |
|---|---|---|---|
| 3,767,322 | 10/1973 | Durgin et al. | 416/97 R |
| 4,252,501 | 2/1981 | Peill | 416/96 A |
| 4,292,008 | 9/1981 | Grosjean et al. . | |
| 4,312,624 | 1/1982 | Steinbauer, Jr. et al. | 415/115 |
| 4,437,810 | 3/1984 | Pearce | 416/96 A |
| 4,526,512 | 7/1985 | Hook | 416/96 A |
| 4,930,980 | 6/1990 | North et al. . | |
| 4,962,640 | 10/1990 | Tobery . | |
| 5,145,315 | 9/1992 | North et al. . | |

FOREIGN PATENT DOCUMENTS

| | | | |
|---|---|---|---|
| 149503 | 7/1986 | Japan | 416/96 A |
| 40001 | 2/1990 | Japan | 416/97 R |
| 980572 | 1/1965 | United Kingdom | 416/97 R |

*Primary Examiner*—Edward K. Look
*Assistant Examiner*—James A. Larson
*Attorney, Agent, or Firm*—M. G. Panian

[57] ABSTRACT

A gas turbine vane airfoil has an aft cavity in which an insert is placed so as to form a cooling air passage between the insert and the walls that form the cavity. The insert serves to distribute cooling air around the passage. Cooling air from the passage exits the vane airfoil via film cooling holes in the pressure surface of the airfoil and via a passage formed in the trailing edge of the airfoil. A W-shaped flexible regulator seal is attached to the trailing edge of the insert and has legs that are pressed against ridges in the airfoil walls. Holes in the regulating seal regulate the amount of cooling air flowing from the passage surrounding the insert to the trailing edge passage, thereby preventing too low a pressure differential between the cooling air in the passage surrounding the insert and the hot compressed gas flowing over the airfoil, which would inhibit adequate film cooling.

13 Claims, 4 Drawing Sheets

GAS TURBINE AIRFOIL WITH A COOLING AIR REGULATING SEAL

BACKGROUND OF THE INVENTION

The present invention relates to an airfoil for use in the turbine section of a gas turbine, such as in a stationary vane or rotating blade airfoil. More specifically, the present invention relates to a cooling air regulating seal for use in a gas turbine airfoil.

A gas turbine employs a plurality of stationary vanes that are circumferentially arranged in rows in a turbine section. Since such vanes are exposed to the hot gas discharging from the combustion section, cooling of these vanes is of utmost importance. Typically, cooling is accomplished by flowing cooling air through cavities, such as fore and aft cavities, formed inside the vane airfoil. A tubular insert is typically disposed in each of these cavities so that passages surrounding the inserts are formed between the inserts and the walls of the airfoil. The inserts have a number of holes distributed around their periphery that distribute the cooling air around these passages.

A major portion of the cooling air flowing through the aft cavity is typically discharged through a cooling air passage in the trailing edge of the airfoil. Although baffles extending between the insert and the airfoil wall have sometimes been used to control the direction of the flow of the cooling air around the passages that surround the insert, the cooling air in those passages was still allowed to flow freely to the passage in the trailing edge for discharge from the airfoil—that is, the flow of cooling air from the passages that surround the insert to the trailing edge passage was not positively regulated. Consequently, the pressure inside the passages surrounding the inserts was set, by and large, by the flow capacity of the trailing edge passage.

Another portion of the cooling air flowing through the aft cavity is typically directed to film cooling air holes in the concave wall that forms the pressure surface of the airfoil near the trailing edge. These film cooling holes direct the cooling air over the vane airfoil pressure surface so as to provide a degree of film cooling near the trailing edge.

The flow rate of the cooling air through the film cooling holes is a function of the pressure differential between the cooling air flowing through the passages surrounding the insert that supply the film cooling holes and the hot compressed gas flowing over the pressure surface of the airfoil. In some modern high performance gas turbines, the gas loading on the vane airfoil is relatively high, thereby reducing this pressure differential. Unfortunately, the essentially unregulated flow of cooling air from the passages surrounding the aft cavity insert to the discharge passage in the trailing edge, discussed above, may reduce the pressure of the cooling air in the cavity surrounding the insert to the point where the pressure differential between it and the hot compressed gas becomes too low to provide sufficient cooling air through the film cooling holes. This situation can result in overheating of the airfoil pressure surface in the vicinity of the trailing edge.

One potential solution to this problem is to dramatically increase the cooling air supplied to the airfoil cavity, thereby increasing the pressure of the cooling air flowing through the passages surrounding the insert. However, such a large increase in cooling air flow is undesirable. Although such cooling air eventually enters the hot gas flowing through the turbine section, little useful work is obtained from the cooling air, since it was not subject to heat up in the combustion section. Thus, to achieve high efficiency, it is crucial that the use of cooling air be kept to a minimum.

It is therefore desirable to provide a scheme for increasing the pressure of the cooling air in the passages surrounding the insert without increasing the flow of cooling air through the cavity.

SUMMARY OF THE INVENTION

Accordingly, it is the general object of the current invention to provide a scheme for increasing the pressure of the cooling air in the passages surrounding the insert without increasing the flow of cooling air through the cavity.

Briefly, this object, as well as other objects of the current invention, is accomplished in a gas turbine comprising (i) a compressor for producing compressed air, (ii) a combustor for heating at least a portion of the compressed air, thereby producing a hot compressed gas, and (iii) a turbine for expanding the hot compressed gas so as to produce shaft power, the turbine having an airfoil disposed therein that is exposed to the hot compressed gas. The airfoil has (i) a plurality of walls defining a cavity enclosed thereby, (ii) a member disposed inside the cavity and enclosing a major portion thereof, a first cooling fluid passage formed between the member and the walls, (iii) a second cooling fluid passage extending from the cavity and in flow communication with the first cooling fluid passage, and (iv) means for regulating the flow of cooling fluid between the first and second cooling fluid passages.

According to one embodiment of the invention, the cooling fluid flow regulating means comprises a seal. At least a portion of the seal extends between at least one of the walls and the member. The seal has a flexible leg portion, and further comprises means for causing the flexible leg portion of the seal to be pressed against one of the walls in response to a pressure differential between the cooling fluid flowing through the first and second passages. In one embodiment, the means for pressing the flexible leg portion against the wall comprises a projection extending outwardly from the wall.

DESCRIPTION OF THE PREFERRED EMBODIMENT

Figure 1:
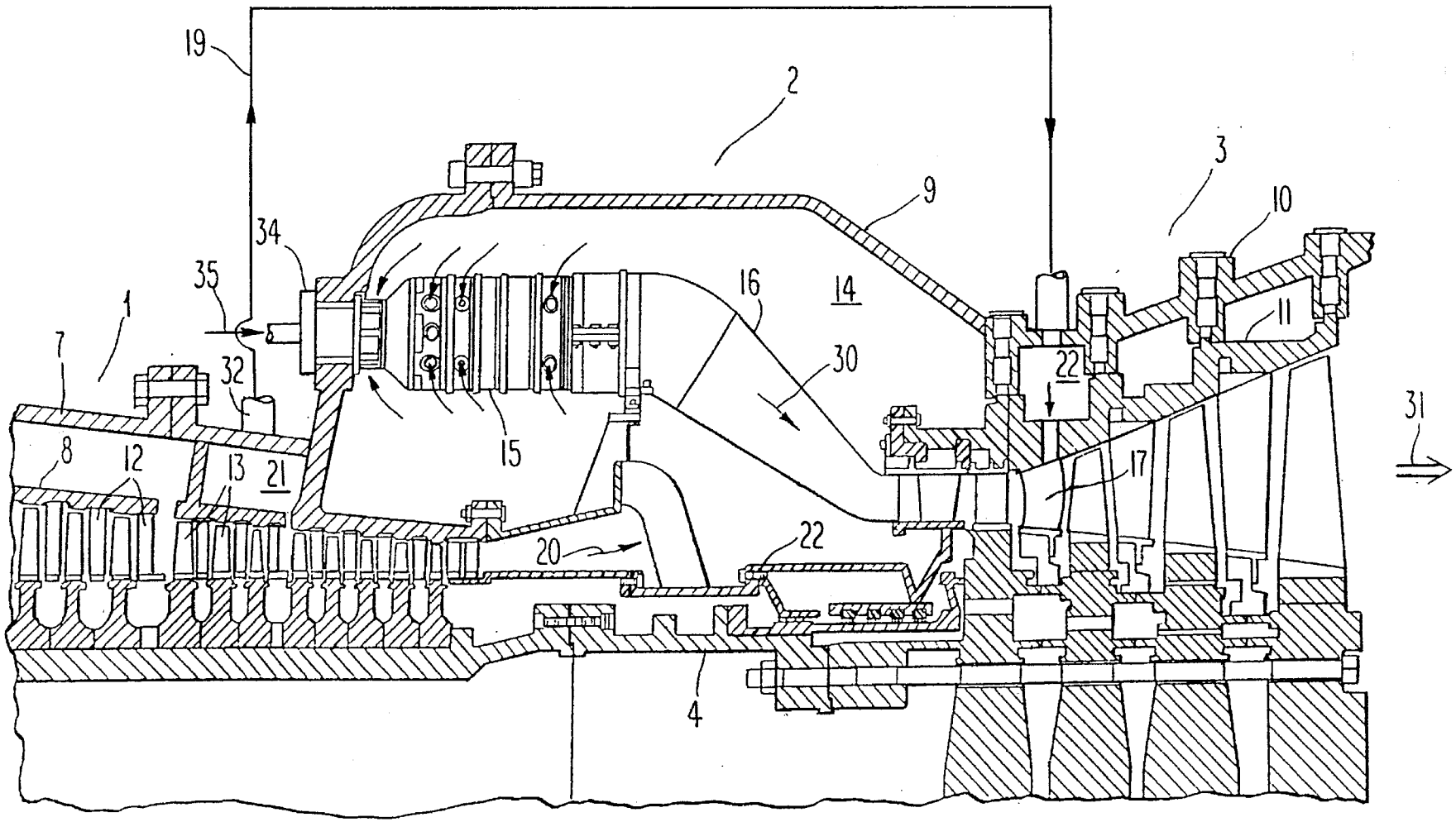
FIG. 1 is a longitudinal cross-section, partially schematic, of a gas turbine incorporating the airfoil of the current invention.

Referring to the drawings, there is shown in FIG. 1 a longitudinal cross-section through a portion of a gas turbine. The major components of the gas turbine are a compressor section 1, a combustion section 2, and a turbine section 3. As can be seen, a rotor 4 is centrally disposed and extends through the three sections. The compressor section 1 is comprised of cylinders 7 and 8 that enclose alternating rows of stationary vanes 12 and rotating blades 13. The stationary vanes 12 are affixed to the cylinder 8 and the rotating blades 13 are affixed to discs attached to the rotor 4.

The combustion section 2 is comprised of an approximately cylindrical shell 9 that forms a chamber 14, together with the aft end of the cylinder 8 and a housing 22 that encircles a portion of the rotor 4. A plurality of combustors 15 and ducts 16 are contained within the chamber 14. The ducts 16 connect the combustors 15 to the turbine section 3. Fuel 35, which may be in liquid or gaseous form —such as distillate oil or natural gas—enters each combustor 15 through a fuel nozzle 34 and is burned therein so as to form a hot compressed gas 30.

The turbine section 3 is comprised of an outer cylinder 10 that encloses an inner cylinder 11. The inner cylinder 11 encloses rows of stationary vanes and rows of rotating blades that are circumferentially arranged around the centerline of the rotor 4. The stationary vanes are affixed to the inner cylinder 11 and the rotating blades are affixed to discs that form a portion of the turbine section of the rotor 4.

In operation, the compressor section 1 inducts ambient air and compresses it. A portion of the air that enters the compressor is bled off after it has been partially compressed and is used to cool the rows 2–4 stationary vanes within the turbine section 3, as discussed more fully below. The remainder of the compressed air 20 is discharged from the compressor section 1 and enters the chamber 14. A portion of the compressed air 20 is drawn from the chamber 14 and used to cool the first row of stationary vanes, as well as the rotor 4 and the rotating blades attached to the rotor. The remainder of the compressed air 20 in the chamber 14 is distributed to each of the combustors 15.

In the combustors 15, the fuel 35 is mixed with the compressed air and burned, thereby forming the hot compressed gas 30. The hot compressed gas 30 flows through the ducts 16 and then through the rows of stationary vanes and rotating blades in the turbine section 3, wherein the gas expands and generates power that drives the rotor 4. The expanded gas 31 is then exhausted from the turbine 3.

The current invention is directed to the cooling of the stationary vanes and will be discussed in detail with reference to the second row of stationary vanes 17. As shown in FIG. 1, a portion 19 of the air flowing through the compressor 1 is extracted from an interstage bleed manifold 21, via a pipe 32, and is directed to the turbine section 3. In the turbine section 3, the cooling air 19 enters a manifold 22 formed between the inner cylinder 11 and the outer cylinder 10. From the manifold 22, the cooling air 19 enters the second row vanes 17.

Figure 2:
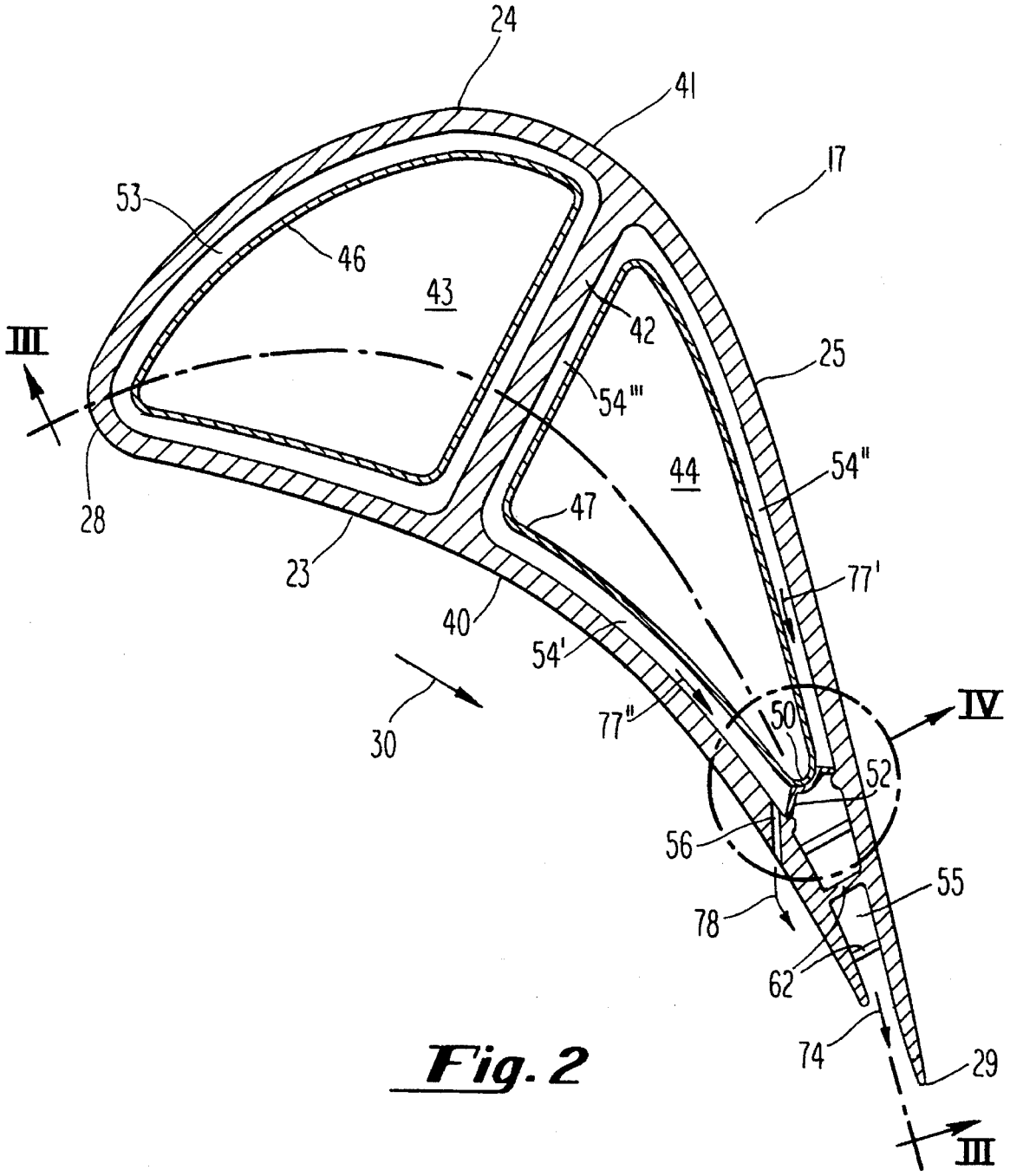
FIG. 2 is a transverse cross-section through the airfoil of the row 2 vane shown in FIG. 1.
Figure 3:
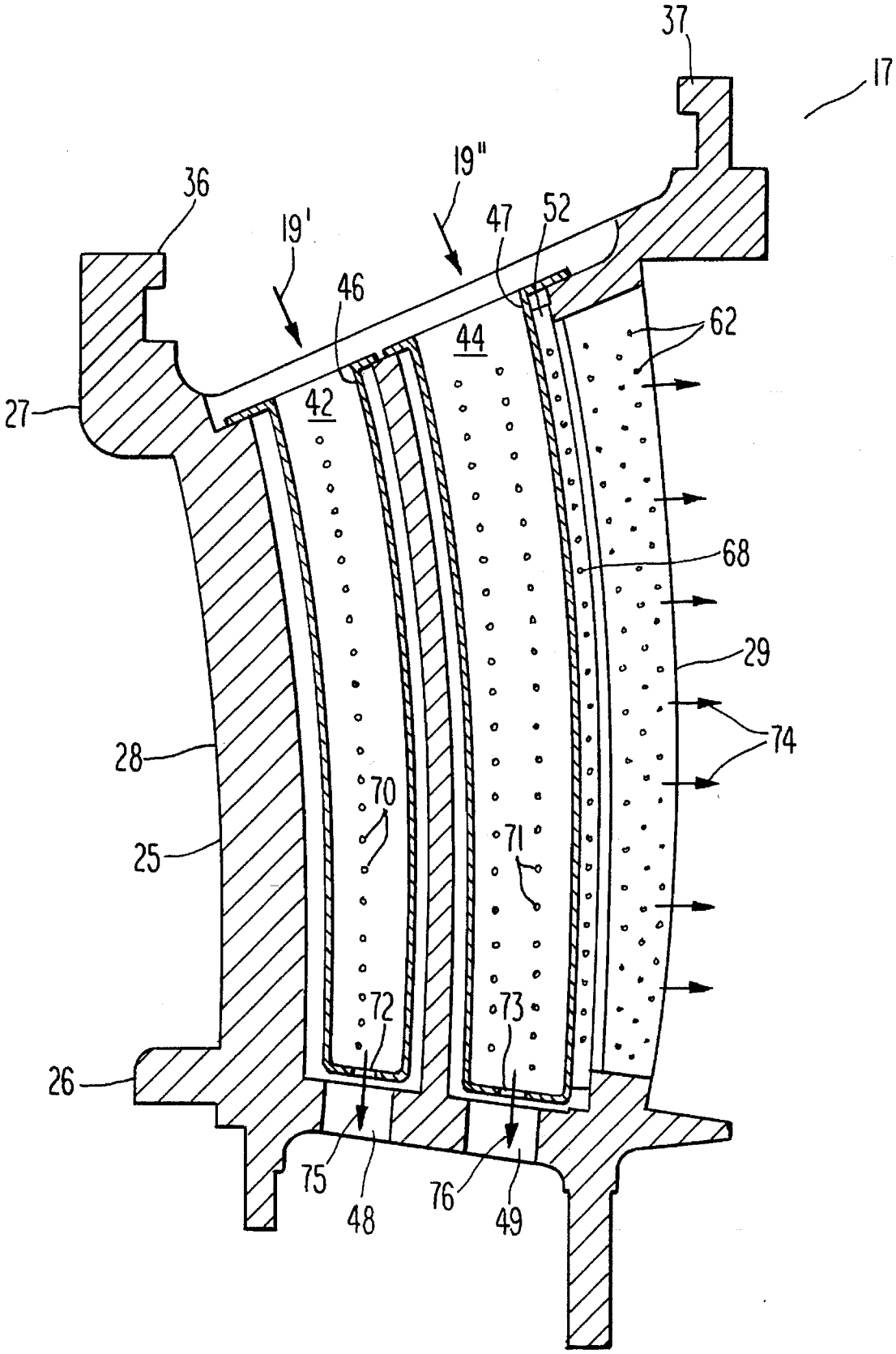
FIG. 3 is a longitudinal cross-section taken through line III—III shown in FIG. 2.

As shown in FIGS. 2 and 3, the vane 17 is comprised of an airfoil portion 25 that is disposed between inner and outer shrouds 26 and 27, respectively. Support rails 36 and 37 are used to attach the vane 17 to the turbine inner cylinder 11. As shown best in FIG. 2, the airfoil portion 25 of the vane 17 is formed by a generally concave shaped wall 40, which forms the pressure surface 23 of the airfoil, and a generally convex wall 41, which forms the suction surface 24 of the airfoil. At their upstream and downstream ends, the walls 40 and 41 form the leading and trailing edges 28 and 29, respectively, of the airfoil 25. The airfoil 25 is substantially hollow and a third wall 42 divides the interior into fore and aft cavities 43 and 44, respectively.

Tubular members 46 and 47—referred to as "inserts"—are attached to the outer shroud 27 and extend into the fore and aft cavities 43 and 44, respectively. The inserts 46 and 47 have the same general shape as the cavities in which they are located but are slightly smaller in size. As a result, cooling air passages 53 and 54, which surround the inserts 46 and 47, respectively, are formed between the inserts and the walls 40–42. The passage 54 can be viewed as having three portions—a first portion 54' located between the insert 47 and the wall 40 that forms the pressure surface 23, a second portion 54" located between the insert and the wall 41 that forms the suction surface 24, and a third portion 54"' located between the insert and the dividing wall 42.

A number of small cooling air holes 70 are formed in the front insert 46. The cooling air holes 70 serve to impinge cooling air on the upstream portion of the airfoil walls 40 and 41 and to distribute a portion of the cooling air 19' around the front cavity 43. Similarly, a number of small cooling holes 71 are formed in the aft insert 47 and serve to impinge cooling air on the downstream portion of the airfoil walls 40 and 41 and to distribute a portion 77 of the cooling air 19" around the aft cavity 44. (For simplicity, only a few rows of insert cooling air holes 70 and 71 are shown in FIG. 3. However, it will be appreciated that a much greater number of such cooling holes will generally be formed in the inserts 46 and 47.)

Although the major portion of the cooling air 19 flowing through the inserts 46 and 47 exits via the holes 70 and 71 distributed around the walls of the inserts, portions 75 and 76 of the cooling air 19 exit through holes 72 and 73 formed in the bottom of the inserts 46 and 47, respectively, as shown in FIG. 3. The cooling air portions 75 and 76 exit the vane 17 through openings 48 and 49 in the inner shroud 26 and serve to pressurize and cool an interstage seal (not shown).

Figure 4:
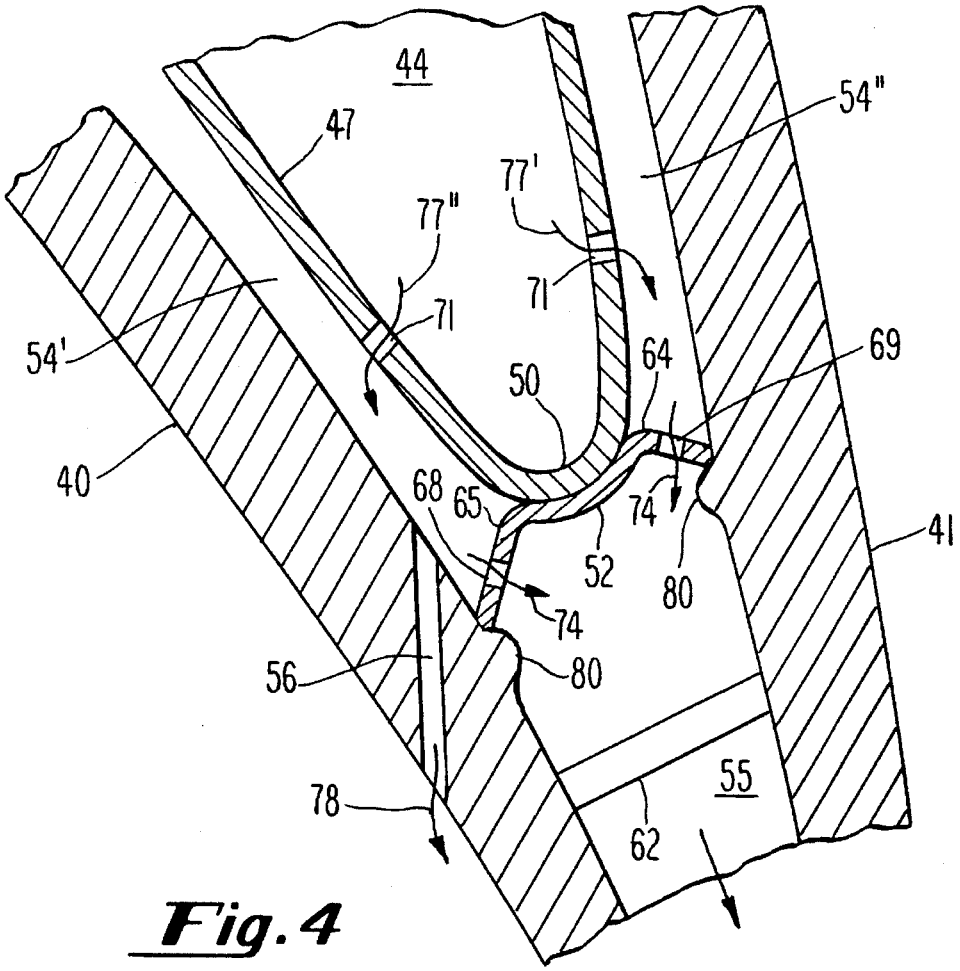
FIG. 4 is a detailed view of the portion of FIG. 3 enclosed by the oval marked IV.

As shown in FIGS. 2 and 4, a cooling air passage 56 is formed in the concave wall 40 of the airfoil 25. Preferably, there are a large number of such passages 56 spaced in a radially extending row up the concave wall 40. The cooling air passages 56 receive a portion 78 of the cooling air 77" flowing in the portion 54' of the passage 54 that is disposed between the aft insert 47 and the concave wall 40. The passages 56 direct the cooling air 78 along the pressure surface 23 of the airfoil 25 so as to provide a measure of film cooling on the pressure surface adjacent the trailing edge 29.

The concave and convex walls 40 and 41, respectively, form a cooling air passage 55 between themselves in the region of the trailing edge 29 of the airfoil 25. A number of pins 62 extend transversely through the passage 55 and serve to create turbulence that increases the heat transfer coefficient of the cooling air 74 flowing through the passage.

Figure 5:
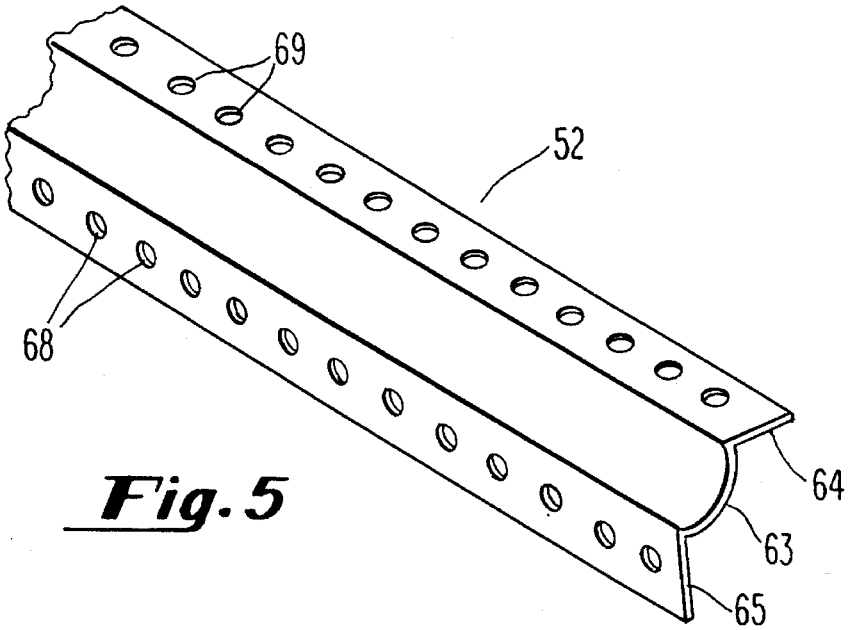
FIG. 5 is an isometric view of a portion of the regulating seal shown in FIG. 4.

According to the current invention, a regulating seal 52 is attached to the trailing edge 50 of the aft insert 47, as shown best in FIG. 4. As shown in FIG. 5, the regulating seal 52 is an elongate member having a generally W-shaped cross-section. The regulating seal 52 is comprised of a central arcuate portion 63, having approximately the same radius of curvature as the trailing edge 50 of the aft insert 47. Preferably, the regulating seal 52 is attached to the aft insert 47 by brazing the central portion 63 to the insert trailing edge 50 prior to installing the aft insert in the cavity 44.

A pair of flexible legs 64 and 65 extend from the central portion 63. One leg 65 spans the portion 54' of the passage 54 that is located between the insert 47 and the wall 40 and the other leg 64 spans the portion 54" of the passage 54 that is located between the insert 47 and the wall 41. A row of holes 68 and 69 are distributed along each of the legs 64 and 65, respectively. Preferably, the diameter of the holes 68 and 69 is relatively small—i.e., approximately 0.1 to 0.2 cm (0.04–0.08 inch) in the preferred embodiment of the invention. Preferably the regulating seal 52 is made from sheet metal approximately 0.25 cm (0.01 inch) thick to ensure adequate flexibility.

According to an important aspect of the current invention, a method is provided for ensuring that the regulating seal legs 64 and 65 form a tight seal with the walls 41 and 40, respectively. As shown in FIG. 4, a pair of radially extending ridges 80 project inwardly from the walls 40 and 41. The ridges 80 are spaced from the trailing edge 50 of the aft insert 47 so that the cooling air pressure differential between the passage 54 surrounding the aft insert 47 and the trailing edge passage 55 presses the flexible legs 64 and 65 of the regulating seal 52 against the ridges, thereby forming a seal. This sealing effect prevents cooling air from flowing from the portions 54' and 54" of the cooling air passage 54 to the trailing edge passage 55 except through the holes 68 and 69 in the regulating seal legs 64 and 65.

In operation, the cooling air 19" enters the aft insert 47 through an opening in the outer shroud 27, as shown in FIG. 3. A first portion 77 of the cooling air 19" is distributed by the holes 71 throughout the passage 54 formed between the insert 47 and the airfoil walls 40–42, as previously discussed. A second portion 76 of the cooling air 19" exits the insert 47 via the bottom hole 73. A first portion 77" of the cooling air 77 flows through the passage 54' and a second portion 77' flows through the passage 54". A first portion 78 of the cooling air 77" exits the airfoil through the holes 56 to provide film cooling of the concave pressure surface 23 adjacent the trailing edge 29, as previously discussed. A second portion of the cooling air 77" combines with the cooling air 77' to form the cooling air 74 that exits the airfoil through the trailing edge passage 55.

As previously discussed, in certain situations, the pressure of the hot compressed gas 30 flowing over the pressure surface 23 of the airfoil 25 may be sufficiently high so that the unregulated flow of cooling air 74 from the passage 54 surrounding the insert 47 to the trailing edge passage 55 would result in a substantial reduction in the pressure of the cooling air 77 in passage 54. This, in turn, would result in a low pressure differential between the cooling air 77" flowing through the passage 54' and the hot compressed gas 30. Consequently, there would be too low a pressure drop to cause adequate flow of film cooling air 78 through the passages 56.

The regulating seal 52 of the current invention prevents this problem by restricting the flow of cooling air 74 from the passage 54 to the trailing edge passage 55 —specifically, the holes 68 in the leg 65 restrict the flow of cooling air 74 from the passage 54' and the holes 69 in the leg 64 restrict the flow of cooling air 74 from the passage 54". By properly sizing the holes 68 and 69 in the regulating seal legs 64 and 65 so as to properly restrict the flow of cooling air 74, an adequate pressure differential can be maintained between the cooling air 77" in the passage 54' and the hot compressed gas 30, thereby ensuring adequate flow of the film cooling air 78 to prevent overheating of the pressure surface 23 in the vicinity of the trailing edge. According to the current invention, this is accomplished while still providing an adequate flow of cooling air 74 through passage 55 to cool the trailing edge region 29.

Although the present invention has been described with reference to the airfoils of the second row of stationary vanes in a gas turbine, the invention is also applicable to other rows of stationary vanes, as well as to the airfoils of the rotating blades. According, the present invention may be embodied in other specific forms without departing from the spirit or essential attributes thereof and, accordingly, reference should be made to the appended claims, rather than to the foregoing specification, as indicating the scope of the invention.

I claim:

1. A gas turbine comprising:

a) a compressor for producing compressed air;

b) a combustor for heating at least a portion of said compressed air, thereby producing a hot compressed gas; and c) a turbine for expanding said hot compressed gas so as to produce shaft power, said turbine having an airfoil disposed therein that is exposed to said hot compressed gas, said airfoil having:

(i) a plurality of walls defining a cavity enclosed thereby, (ii) a member disposed inside said cavity and enclosing a portion thereof, a first cooling fluid passage formed between said member and said walls, (iii) a second cooling fluid passage extending from said cavity and in flow communication with said first cooling fluid passage, (iv) a seal for regulating the flow of cooling fluid between said first and second cooling passages, said seal comprising a flexible leg portion; and (v) means for causing said flexible leg portion to be pressed against one of said walls in response to a pressure differential between cooling fluid flowing through said first and second passages.

2. The gas turbine according to claim 1, wherein at least a portion of said seal extends between at least one of said walls and said member.

3. The gas turbine according to claim 1, wherein said means for pressing said flexible leg portion against said one of said walls comprises a projection extending outwardly from said one of said walls.

4. The gas turbine according to claim 1, wherein said seal has a plurality of holes formed therein.

5. The gas turbine according to claim 1, wherein said member is substantially tubular and has a plurality of cooling fluid holes formed therein, said cooling fluid holes in flow communication with said first cooling fluid passage.

6. The gas turbine according to claim 1, wherein said second cooling fluid passage is in flow communication with said hot compressed gas being expanded in said turbine.

7. The gas turbine according to claim 6, wherein said airfoil has a trailing edge portion, said second cooling fluid passage being formed in said trailing edge portion.

8. In a gas turbine having a turbine section through which a hot compressed gas flows and to which a cooling fluid is supplied, an airfoil comprising:

a) first and second walls defining a cavity therebetween;

b) an insert disposed in said cavity and having means for distributing at least a portion of said cooling fluid around said cavity, said insert having a trailing edge portion; and c) sealing means projecting from the trailing edge portion of said insert and extending to said first and second walls, said sealing means having a plurality of cooling fluid holes formed therein.

9. The air foil according to claim 8, wherein said first and second walls are exposed to said hot compressed gas.

10. The air foil according to claim 8 wherein said first wall has a surface exposed to said hot compressed gas, a cooling fluid passage being formed in said first wall, said cooling fluid passage having means for directing cooling fluid from said cavity to flow over said first wall surface.

11. In a gas turbine having a turbine section through which a hot compressed gas flows and to which a cooling fluid is supplied, an airfoil comprising:

a) at least first and second walls defining a cavity therebetween, at least one of said first and second walls forming a trailing edge portion of said airfoil, said first wall being exposed to said flow of hot compressed gas;

b) an insert disposed in said cavity and forming first and second cooling fluid passages disposed between said insert and said first and second walls, respectively, said first and second cooling fluid passages being in flow communication;

c) a third cooling fluid passage formed in said trailing edge portion and being in flow communication with said hot compressed gas and with said first and second cooling fluid passages;

d) a fourth cooling fluid passage formed in said first wall and placing said first cooling fluid passage in flow communication with said hot compressed gas; and e) a seal for restricting cooling fluid flow from said first and second cooling fluid passages to said third cooling fluid passage so as to increase the difference in pressure between said cooling fluid flowing in said first passage and said hot compressed gas, thereby facilitating cooling fluid flow from said first cooling fluid passage to said hot compressed gas through said fourth cooling fluid passage, said seal having a first portion disposed between said first cooling fluid passage and said third cooling fluid passage and a second portion disposed between said second cooling fluid passage and said third cooling fluid passage, said first and second portions of said seal having a plurality of cooling fluid holes formed therein.

12. In a gas turbine having a turbine section through which a hot compressed gas flows and to which a cooling fluid is supplied, an airfoil comprising:

a) at least first and second walls defining a cavity therebetween, at least one of said first and second walls forming a trailing edge portion of said airfoil, said first wall being exposed to said flow of hot compressed gas;

b) an insert disposed in said cavity and forming first and second cooling fluid passages disposed between said insert and said first and second walls, respectively, said first and second cooling fluid passages being in flow communication;

c) a third cooling fluid passage formed in said trailing edge portion and being in flow communication with said hot compressed gas and with said first and second cooling fluid passages;

d) a fourth cooling fluid passage formed in said first wall and placing said first cooling fluid passage in flow communication with said hot compressed gas; and e) a seal for restricting cooling fluid flow from said first and second cooling fluid passages to said third cooling fluid passage so as to increase the difference in pressure between said cooling fluid flowing in said first passage and said hot compressed gas, thereby facilitating cooling fluid flow from said first cooling fluid passage to said hot compressed gas through said fourth cooling fluid passage, said seal having a first flexible portion disposed between said first cooling fluid passage and said third cooling fluid passage, and a second flexible portion disposed between said second cooling fluid passage and said third cooling fluid passage.

13. In a gas turbine having a turbine section through which a hot compressed gas flows and to which a cooling fluid is supplied, an airfoil comprising:

a) at least first and second walls defining a cavity therebetween, at least one of said first and second walls forming a trailing edge portion of said airfoil, said first wall being exposed to said flow of hot compressed gas;

b) an insert disposed in said cavity and forming first and second cooling fluid passages disposed between said insert and said first and second walls, respectively, said first and second cooling fluid passages being in flow communication;

c) a third cooling fluid passage formed in said trailing edge portion and being in flow communication with said hot compressed gas and with said first and second cooling fluid passages;

d) a fourth cooling fluid passage formed in said first wall and placing said first cooling fluid passage in flow communication with said hot compressed gas; and e) means for restricting cooling fluid flow from said first and second cooling fluid passages to said third cooling fluid passage so as to increase the difference in pressure between said cooling fluid flowing in said first passage and said hot compressed gas, thereby facilitating cooling fluid flow from said first cooling fluid passage to said hot compressed gas through said fourth cooling fluid passage, said cooling fluid restricting means comprising:

(i) a seal having a first portion disposed between said first cooling fluid passage and said third cooling fluid passage and a second portion disposed between said second cooling fluid passage and said third cooling fluid passage, (ii) means for causing said first and second portions of said seal to be pressed against said first and second walls.

* * * * *